United States Patent [19]

Ritchie

[11] 4,239,071

[45] Dec. 16, 1980

[54] SYSTEM FOR PRODUCING VENEER FROM DETERIORATED CORE LOGS

[76] Inventor: Lloyd I. Ritchie, 17810 Burke Pl. N., Seattle, Wash. 98133

[21] Appl. No.: 14,073

[22] Filed: Feb. 22, 1979

[51] Int. Cl.[2] ..... B27L 5/00

[52] U.S. Cl. ..... 144/209 R; 82/47; 144/3 R; 144/212; 144/325; 144/326 R

[58] Field of Search ..... 82/46, 47, 48, 52, 53; 144/1 R, 2 R, 3 R, 42, 209 R, 209 A, 211, 212, 215, 321, 323, 325, 326 R

[56] References Cited

U.S. PATENT DOCUMENTS

| | | | |
|---|---|---|---|
| 1,293,230 | 2/1919 | Stafford | 144/209 R |
| 3,221,787 | 12/1965 | Hitt | 144/209 R |
| 3,683,983 | 8/1972 | Logan | 144/209 R X |
| 3,842,874 | 10/1974 | Noriyuki et al. | 144/3 R X |

*Primary Examiner*—W. Donald Bray
*Attorney, Agent, or Firm*—Dowrey & Cross

[57] ABSTRACT

A system for producing veneer from deteriorated or hollow core logs. The log is rotated about its longitudinal axis in a lathe by means secured to the log at or near its outer circumferential surface. Two kerfs are cut around the circumference of the rotating log and the veneer blade is then brought to bear against a portion of the rotating log between the kerfs such that a sheet of veneer is cut from that log portion. The length of the veneer blade is no less than the distance between the inner kerf edges and no greater than the distance between the outer kerf edges.

8 Claims, 4 Drawing Figures

SYSTEM FOR PRODUCING VENEER FROM DETERIORATED CORE LOGS

FIELD OF THE INVENTION

This invention relates to systems for producing veneer from logs.

BACKGROUND OF THE INVENTION

Prior techniques for producing veneer from logs have involved mounting a log in a lathe by means inserted into the log core and then peeling veneer off the log using a veneer knife having a blade length greater than the length of the log. This technique, however, is incapable of producing veneer from logs which are hollow or which have deteriorated cores.

SUMMARY OF THE INVENTION

The present invention provides a system for producing veneer from a hollow or deteriorated core log. The log to be peeled into veneer is rotated about its longitudinal axis by means secured to the log at or near its outer circumferential surface, and two kerfs are cut in the log, each kerf extending around the circumference of the log in a plane perpendicular to such axis. A veneer knife is then brought to bear against the portion of the rotating log between the kerfs such that a sheet of veneer is cut from such log portion. The blade length of the veneer knife is greater than or equal to the distance between the interior kerf edges and less than or equal to the distance between the exterior kerf edges. The veneer is thereby peeled smoothly from the log, without tearing along its lateral edges.

These and other features, objects and advantages of the invention will be apparent from the detailed description and claims to follow taken in conjunction with the accompanying drawings.

DETAILED DESCRIPTION OF THE DRAWINGS

Figure 1:
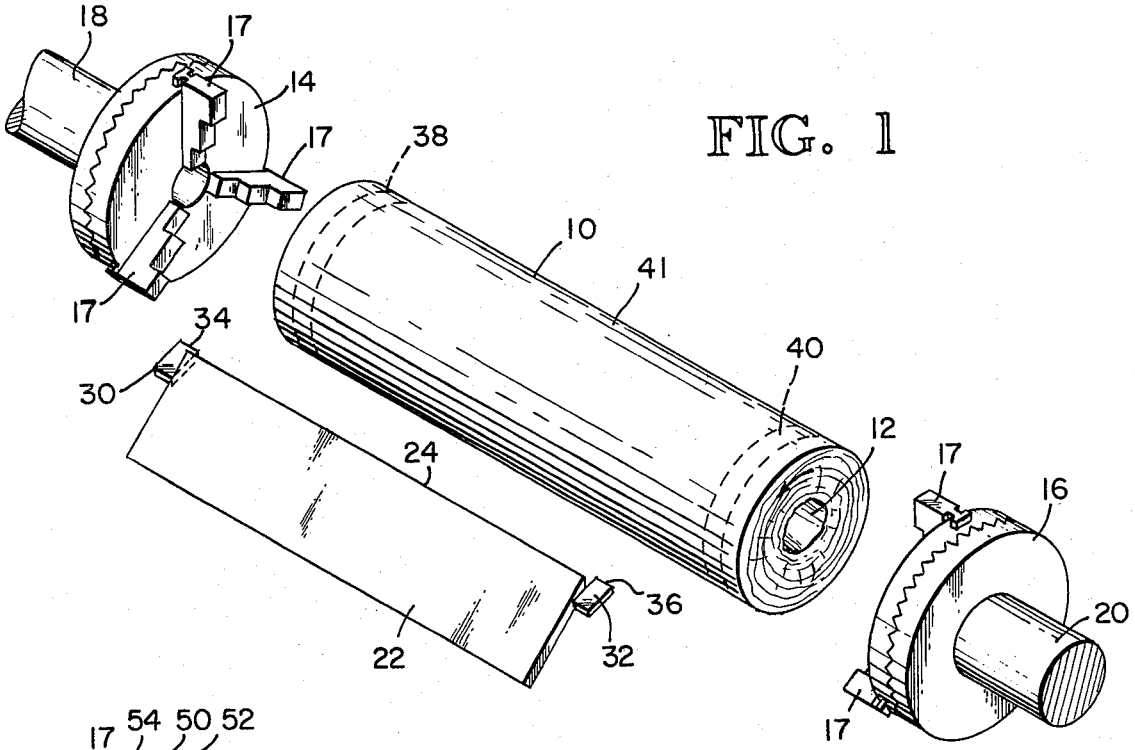
FIG. 1 is an exploded perspective view of a system for peeling a deteriorated core log according to the present invention.

Referring initially to FIG. 1, a log 10 is shown having a core 12 which is hollow or which consists of soft or deteriorated wood. The log is secured between chucks 14, 16, the chucks being in turn mounted on shafts or lathe spindles 18, 20. Chucks 14, 16 include jaws 17 which may be radially adjusted in unison to grip the log at its outer circumferential surface and to center the log with respect to spindles 18, 20. Spindles 18, 20 are part of a lathe (not shown) for producing veneer from logs. The lathe rotates spindles 18, 20, and thereby rotates log 10 about its longitudinal axis. The general design of such lathes is conventional and does not form a part of the present invention. Any means capable of securing a log at or near its outer circumferential surface and centering such log in the lathe could be used in place of chucks 14, 16.

Figure 2:
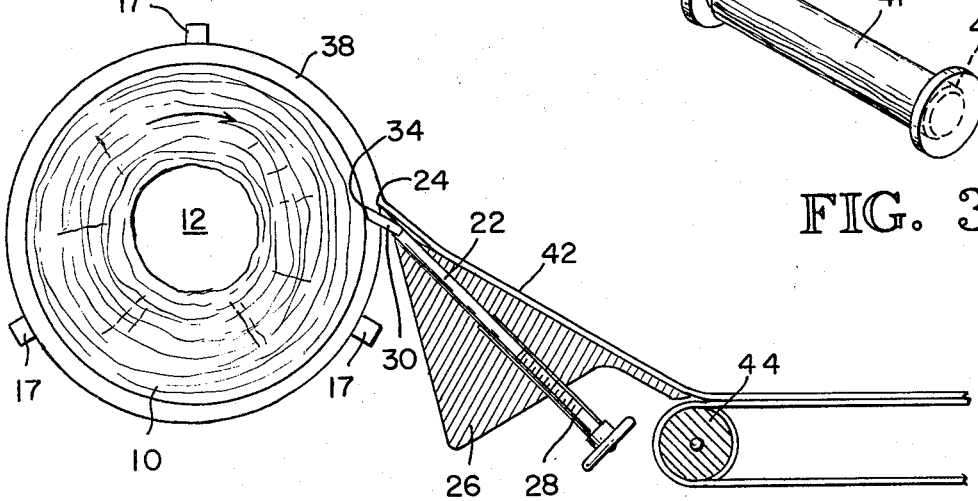
FIG. 2 is a cross-sectional view of a log being peeled according to the system of the present invention.

The lathe also includes a veneer knife 22 having a blade 24. Knife 22 is mounted by conventional means such that blade 24 is spaced approximately horizontally from the axis of rotation of spindles 18, 20 and such that the blade may be moved toward such axis during a peeling operation as the diameter of log 10 is decreased. A portion of such conventional mounting means, comprising knife frame 26 and adjusting screw 28, is illustrated in FIG. 2. Knife 22 rests in a slot in knife frame 26, and its position in such slot is adjustable by means of screw 28.

Secured to the lateral ends of veneer knife 22 are kerf knives 30, 32 having respective kerf blades 34, 36. Kerf blades 34, 36 and knife blade 24 have conventional beveled designs as best shown in FIG. 2. The kerf knives 30, 32 are positioned such that kerf blades 34, 36 extend closer to the axis of rotation of spindles 18, 20 and log 10 than veneer knife blade 24 by a distance at least equal to the thickness of the veneer to be cut.

To produce veneer from a hollow or deteriorated core log according to the system of the present invention, the log is first mounted and centered in chucks 14, 16. The hollow or deteriorated core of the log does not interfere with this mounting operation, since the chuck jaws 17 grip the log at its outer circumferential surface. After the log is mounted and centered, the lathe is energized such that log 10 is rotated about its longitudinal axis, and veneer knife 22 and kerf knives 30, 32 are moved horizontally into contact with the log. Kerf blades 30, 32 contact the log first and begin cutting kerfs 38, 40 respectively. Veneer knife blade 24 then is brought into contact with the portion 41 of log 10 lying between kerfs 38, 40, and cuts therefrom veneer strip 42 (FIG. 2). Veneer 42 slides down the upper surface of knife frame 26 onto conveyor 44 and is carried away by such conveyor for further processing.

Figure 3:
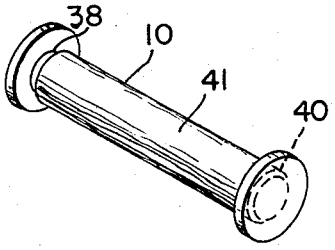
FIG. 3 is a perspective view of a log which has been partially peeled according to the system of the present invention.

FIG. 3 illustrates a log that has been partially peeled by the system of the present invention. Since the kerf knives are always at least one veneer thickness closer to log 10 than the veneer knife, kerfs 38, 40 always extend at least one veneer thickness below the surface of log portion 41 between the kerfs. The veneer knife blade therefore must separate the veneer strip being cut only from the log immediately beneath such strip, and not from portions of the log lying to either side. This is a requirement for any practical veneer peeling system. In conventional veneer producing operations using solid core logs, the same result is achieved by mounting the log along its core and by providing a veneer knife blade longer than the log to be peeled.

Figure 4:
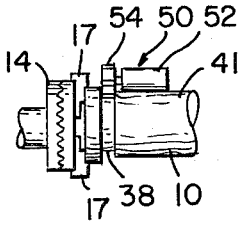
FIG. 4 is a top elevational view of a portion of a second embodiment of the present invention wherein routers are used to cut the kerfs.

Kerfs 38, 40 may be cut by means other than kerf knives mounted to veneer knife 32. The kerf cutting means could comprise a router or other well known cutting means, and could be mounted either to veneer knife 22 as described above or independently of the veneer knife at any position around the circumference of log 10. If the kerf cutting means is mounted independently of veneer knife 22, then additional means must be provided to control the position of the kerf cutting means relative to that of the veneer knife. One embodiment including such means is shown in FIG. 4, wherein kerf 38 is cut in log 10 by means of router 50. The router has a body portion 52 which is mounted by means not shown to bear against portion 41 of log 10. The cutting portion 54 of router 50 has a diameter greater than body portion 52 by an amount at least equal to the thickness of the veneer being cut. The depth of kerf 38 beneath the surface of log portion 41 is therefore always at least as great as the thickness of the veneer. Alternatively, the means for controlling the position of the kerf cutting means could comprise a sensor having an arm spring loaded to bear against log portion 41, and an electrical/-hydraulic control system responsive to the position of such arm to advance the kerf cutting means such that the kerfs are always at least one veneer thickness beneath the surface of log portion 41. In any configuration of the kerf cutting means and the veneer knife, the veneer knife must have a length equal to or greater than the distance between the inner kerf edges, and less than or equal to the distance between the outer kerf edges. Preferred embodiments are those in which the kerfs are cut as close to the log securing and centering means as practical to minimize waste, and in which the kerf cutting means are positioned on a level with or beneath the log to facilitate the disposal of waste.

While the preferred embodiments of the invention have been illustrated and described herein, it should be understood that variations and alternatives will be apparent to one skilled in the art. Accordingly, the invention is not to be limited to the specific embodiments illustrated and described herein, and the scope and spirit of the invention are to be understood by reference to the following claims.

What is claimed is:

1. A method of producing veneer from a deteriorated or hollow core log, comprising the steps of:

securing the log substantially at or near its outer circumferential surface by means of rotatable securing means; rotating said securing means whereby said log is rotated about its longitudinal axis;

cutting two kerfs in the log, each kerf extending around the circumference of the log; and bringing a veneer blade to bear against the portion of the rotating log between the kerfs such that a sheet of veneer is cut from said log portion, the veneer blade having a length no less than the distance between the inner kerf edges and no greater than the distance between the outer kerf edges.

2. The method of claim 1, wherein the kerfs are cut at the same time that the veneer is cut from said log portion, the kerfs extending into the log more deeply than the veneer blade by a distance at least as great as the thickness of the veneer being cut.

3. The method of claim 1, wherein the rotating step comprises mounting the log in a lathe having spaced apart shaft means positioned along a common axis and means mounted to the shaft means for securing each end of the log such that the log is centered with respect to said axis and secured in the lathe at or near its outer circumferential surface, and energizing the lathe such that the log is rotated about said axis.

4. An apparatus for producing veneer from a deteriorated or hollow core log, comprising:

lathe means for rotating the log about its longitudinal axis, the lathe means including means for securing the log substantially at or near its outer circumferential surface;

kerf cutting means for cutting two kerfs around the circumference of the log; and veneer cutting means for cutting a sheet of veneer from the log rotated by the lathe means, the veneer cutting means including a blade moveable against that portion of the outer circumferential surface of the log between the kerfs, the blade having a length no less than the distance between the inner kerf edges and no greater than the distance between the outer kerf edges.

5. The apparatus of claim 4, wherein the lathe means comprises a pair of spaced apart shaft means positioned along a common axis, securing means mounted to the shaft means for securing each end of a log at or near the outer circumferential surface of the log, the securing means including means for centering the log with respect to said axis, and means for rotating the shaft means about said axis.

6. The apparatus of claim 5, wherein the kerf cutting means comprises two kerf knives mounted on said blade adjacent the respective two ends of said blade.

7. The apparatus of claim 5, wherein the securing means comprises chucks.

8. The apparatus of claim 5, wherein the kerf cutting means comprises a router having a body portion and a cutting portion, and means for mounting the router such that said body portion bears against the outer circumferential surface of the log between the kerfs.

* * * * *